US005690506A

United States Patent [19]

Lin

[11] Patent Number: 5,690,506

[45] Date of Patent: Nov. 25, 1997

[54] DECORATIVE LAMP HOLDER

[76] Inventor: Mei Lu Lin, 56, Min Sheng Street, Fengyuan, Taichung, Taiwan

[21] Appl. No.: 615,541

[22] Filed: Mar. 11, 1996

[51] Int. Cl.[6] ..... H01R 4/24

[52] U.S. Cl. ..... 439/419; 439/340

[58] Field of Search ..... 439/419, 340

[56] References Cited

U.S. PATENT DOCUMENTS

| | | | |
|---|---|---|---|
| 3,128,141 | 4/1964 | Krupp et al. | 439/419 |
| 5,366,386 | 11/1994 | Liao | 439/419 |
| 5,421,742 | 6/1995 | Huang | 439/419 |
| 5,474,467 | 12/1995 | Chen | 439/419 |
| 5,492,483 | 2/1996 | Cheng et al. | 439/419 |
| 5,518,425 | 5/1996 | Tsai | 439/419 |
| 5,547,392 | 8/1996 | Cheng et al. | 439/419 |
| 5,552,348 | 9/1996 | Wu | 439/419 |
| 5,556,298 | 9/1996 | Huang | 439/419 |
| 5,569,044 | 10/1996 | Huang | 439/419 |

FOREIGN PATENT DOCUMENTS

| | | | |
|---|---|---|---|
| 0914818 | 1/1963 | United Kingdom | 439/419 |

*Primary Examiner*—Gary F. Paumen
*Assistant Examiner*—Katrina Davis

[57] ABSTRACT

A decorative lamp holder has a bulb on a socket shell. The socket shell comprises an interior, an inserted groove formed on an inner periphery of the socket shell longitudinally, an outer recess at the bottom of the socket shell, an inserted hole and a positioning slot formed at the bottom of the socket shell. The upper portion of the inserted groove has a C-shaped groove. The bottom of the inserted groove has a rectangular groove and an outcurved groove adjacent to the rectangular groove. A solid shortened copper plate is inserted in the inserted hole. A rigid, hollow elongated copper plate is inserted in the inserted groove. The elongated copper plate has an elastic plate at the outer periphery of the elongated copper plate, two laternal protrusions at the lower portion of the elongated copper plate, and a sharp end. A socket cap is inserted beneath the bottom of the socket shell.

1 Claim, 7 Drawing Sheets

DECORATIVE LAMP HOLDER

BACKGROUND OF THE INVENTION

The invention relates to a decorative lamp holder. More particularly, the invention relates to a lamp holder which contains a hollow elongated copper plate.

Referring to FIGS. 1, 1A and 2, a decorative lamp holder has a bulb 20 on a socket shell 10. The socket shell 10 comprises an interior 11 to receive the bulb 20, an inserted groove 12 formed on an inner periphery of the socket shell 10 longitudinally, an outer recess 15 at the bottom of the socket shell 10, an inserted hole 151 and a positioning slot 16 formed at the bottom of the socket shell 10. A solid shortened copper plate 14 with a tip 141 is inserted in the inserted hole 151, and the upper portion of the shortened copper plate 14 is bent flatly. A solid elongated copper plate 13 is inserted in the inserted groove 12. The elongated copper plate 13 has an elastic plate 133, two laternal protrusions 132 and a sharp end 131. The tip 141 of the shortened copper plate 14 and the sharp end 131 of the elongated copper plate 13 are inserted in the corresponding wires 21, respectively. The shortened copper plate 14 contacts the lower end 201 of the bulb 20. The elastic plate 133 contacts the outer thread of the bulb 20. A socket cap 17 is inserted beneath the bottom of the socket shell 10. As shown in FIG. 4, the inserted groove 12" has a rectangular shape. As shown in FIG. 3, the inserted groove 12' has a dovetail shape. The elongated copper plate 13 is not easily inserted in the inserted groove 12. Further, the elongated copper plate 13 is not very rigid so that it is easily bent and deformed while the elongated copper plate 13 is inserted in the inserted groove 12 forcedly.

SUMMARY OF THE INVENTION

An object of the invention is to provide a lamp holder which contains a hollow elongated copper plate with a strong and rigid structure.

DETAILED DESCRIPTION OF THE INVENTION

Figure 1:
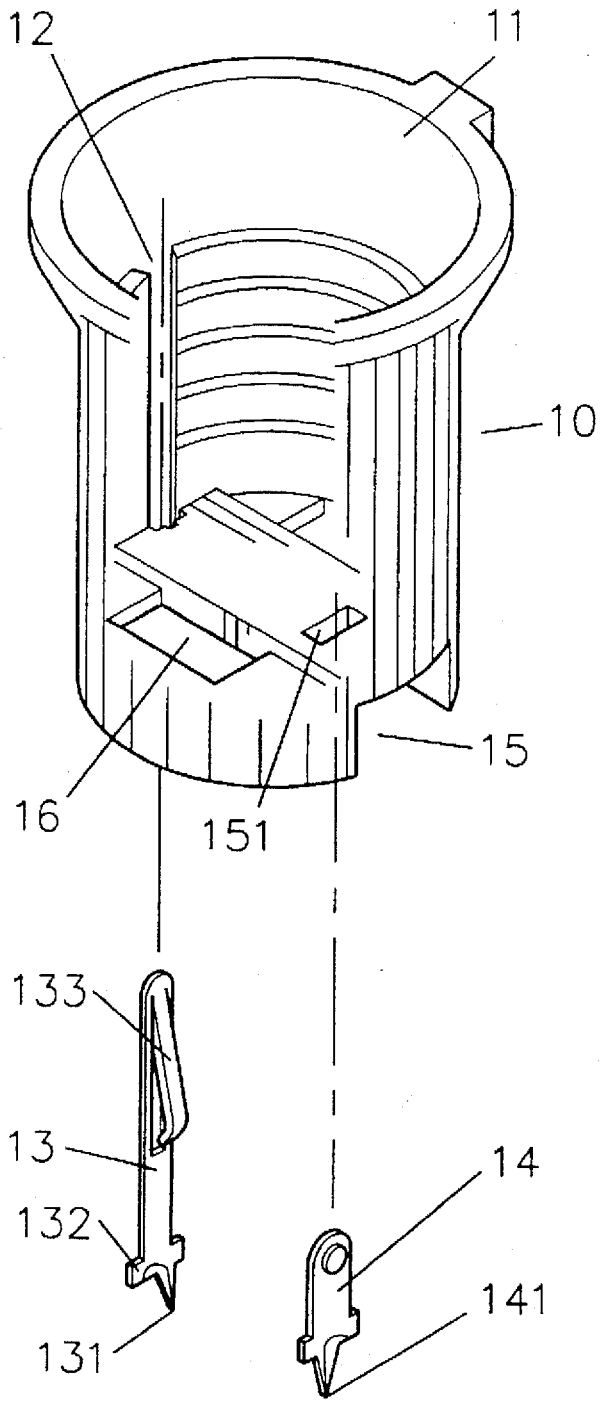
FIG.1 (Prior Art)
FIG. 1 is a perspective exploded view of a decorative lamp holder of the prior art.
Figure 1A:
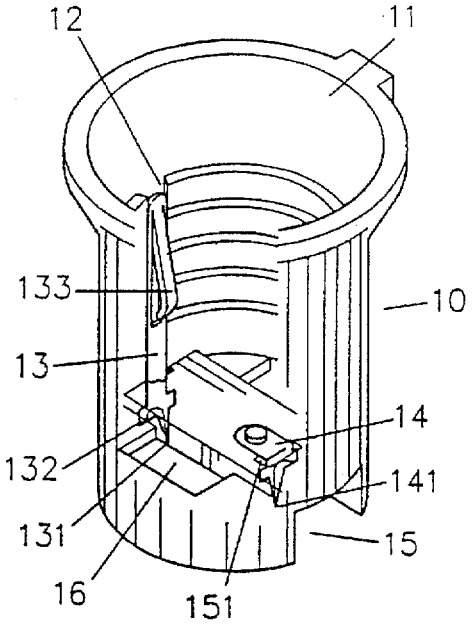
FIG.1A (Prior Art)
FIG. 1A is a perspective assembly view of FIG. 1.
Figure 3:
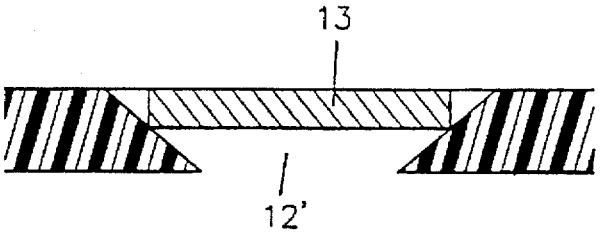
FIG.3 (Prior Art)
FIGS. 3 and 4 are cross-sectional views of various inserted grooves of the prior art.
Figure 4:
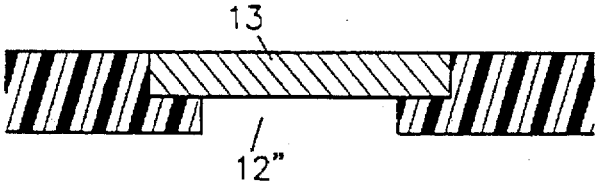
FIG.4 (Prior Art)
Figure 2:
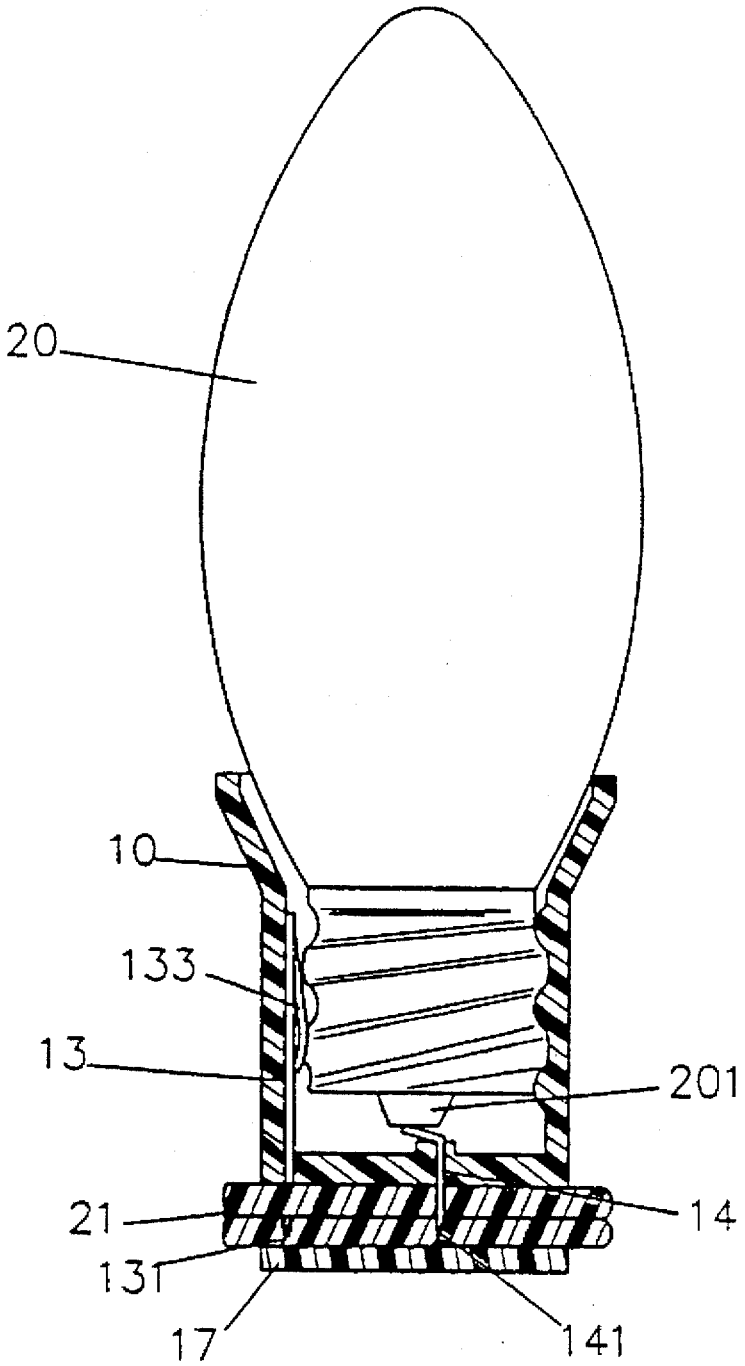
FIG.2 (Prior Art)
FIG. 2 is a cross-sectional view of a decorative lamp holder and a lamp bulb of the prior art.
Figure 5:
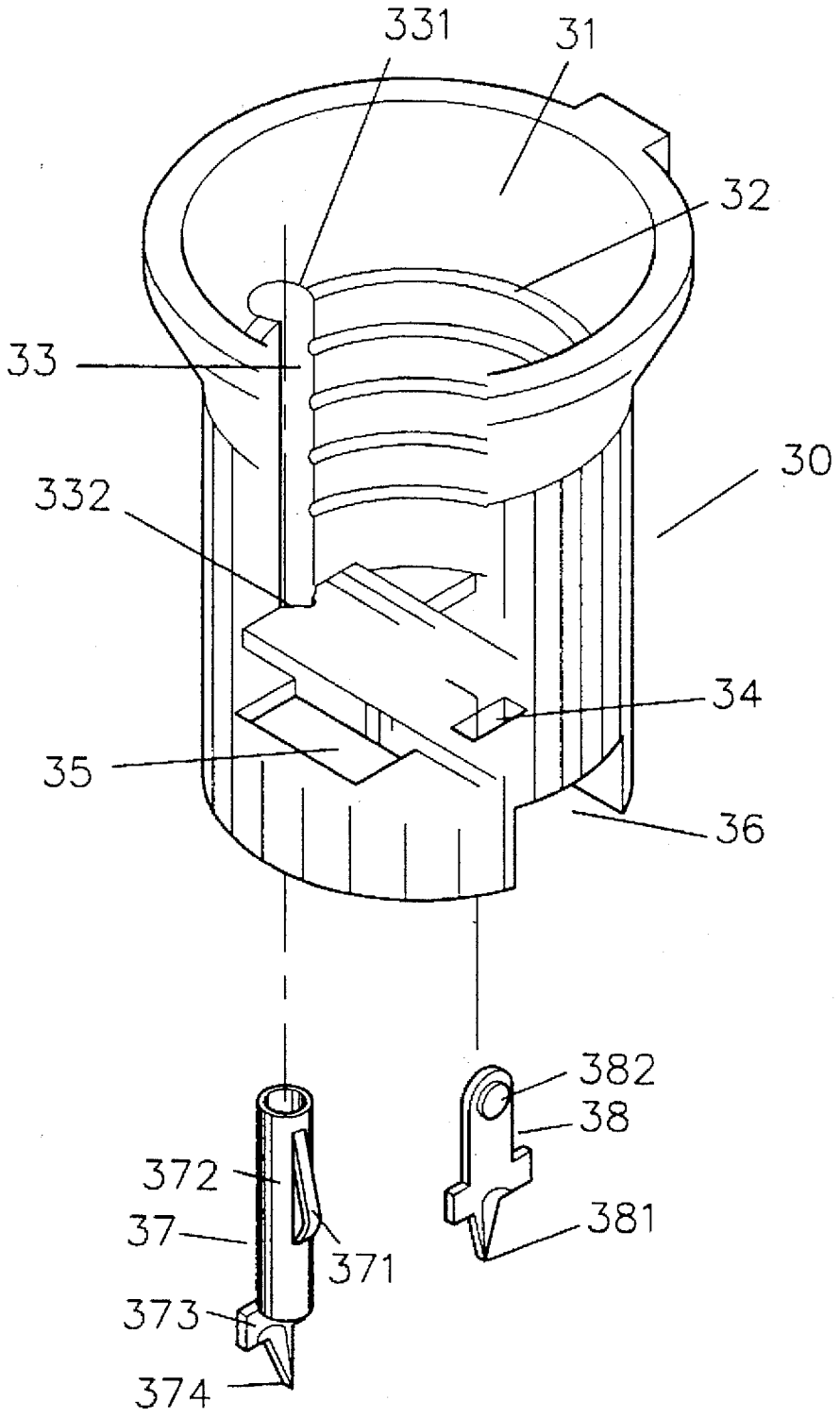
FIG. 5 is a perspective exploded view of a decorative lamp holder of a preferred embodiment in accordance with the invention.
Figure 6:
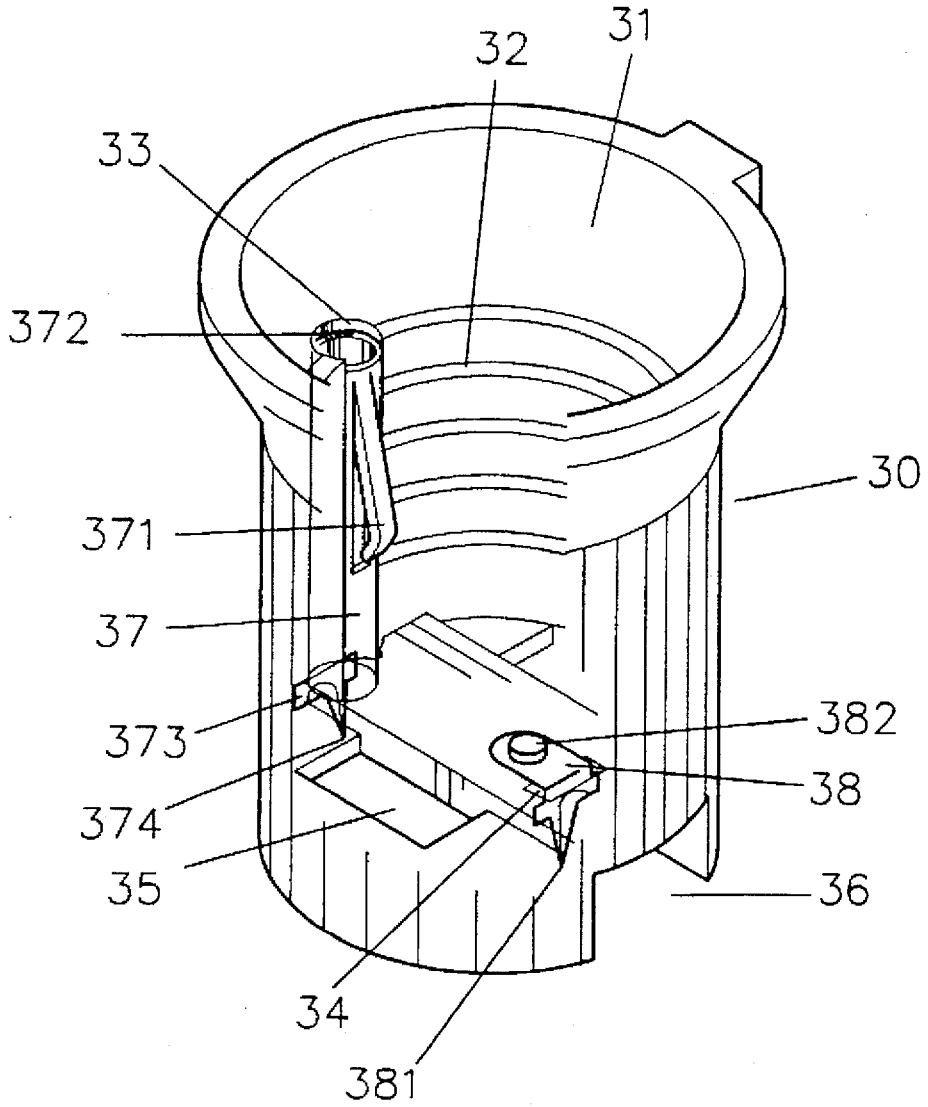
FIG. 6 is a perspective assembly view of FIG. 5.
Figure 7:
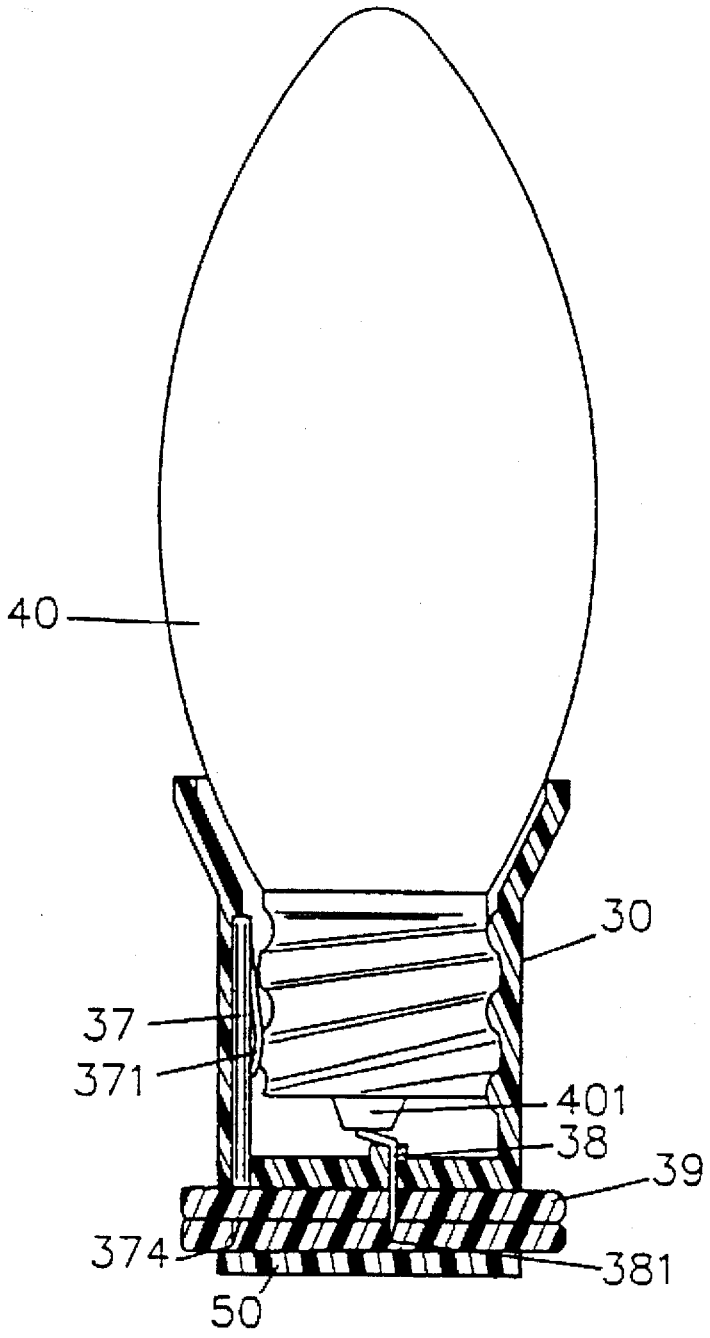
FIG. 7 is a cross-sectional view of a decorative lamp holder and a lamp bulb.

Referring to FIGS. 5 to 9, a decorative lamp holder has a bulb 40 on a socket shell 30. The socket shell 30 comprises an interior 31 to receive the bulb 40, an inserted groove 33 formed on an inner periphery of the socket shell 30 longitudinally, an outer recess 36 at the bottom of the socket shell 30, an inserted hole 34 and a positioning slot 35 formed at the bottom of the socket shell 30. The upper portion of the inserted groove 33 has a C-shaped groove 331. The bottom of the inserted groove 33 has a rectangular groove 333 and an outcurved groove 332 adjacent to the rectangular groove 333. A solid shortened copper plate 38 with a tip 381 and an upper round protrusion 382 is inserted in the inserted hole 34, and the upper portion of the shortened copper plate 38 is bent flatly. A rigid, hollow elongated copper plate 37 is inserted in the inserted groove 33. The elongated copper plate 37 has an elastic plate 371 at the outer periphery of the elongated copper plate 37, two laternal protrusions 373 at the lower portion of the elongated copper plate 37, and a sharp end 374. The tip 381 of the shortened copper plate 38 and the sharp end 374 of the elongated copper plate 37 are inserted in the corresponding wires 39, respectively. The shortened copper plate 38 contacts the lower end 401 of the bulb 40. The elastic plate 371 contacts the outer thread of the bulb 40. A socket cap 50 is inserted beneath the bottom of the socket shell 30.

Figure 9:
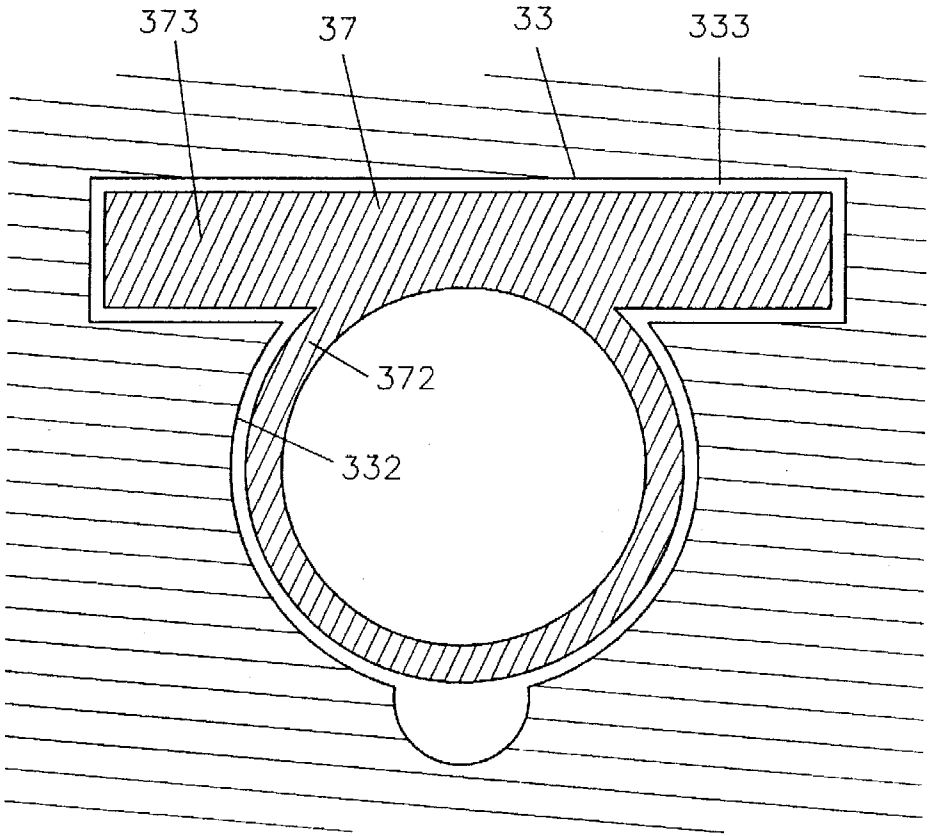
FIG. 9 is a cross-sectional view of an inserted groove and a hollow elongated copper plate.
Figure 8:
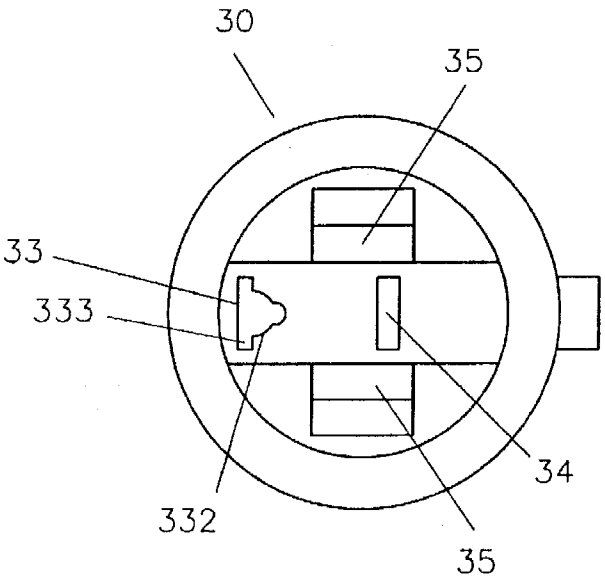
FIG. 8 is a perspective assembly view of FIG. 6.

Referring to FIG. 9, the elongated copper plate 37 is rigid. Thus the elongated copper plate 37 will not be bent nor deformed while it is inserted in the inserted groove 33.

The invention is not limited to the above embodiment but various modification thereof may be made. Further, various changes in form and detail may be made without departing from the scope of the invention.

I claim:

1. A decorative lamp holder comprising:

a socket shell comprising an interior, an inserted groove formed on an inner periphery of said socket shell longitudinally, an outer recess at a bottom of said socket shell, an inserted hole and a positioning slot formed at said bottom of said socket shell;

an upper portion of said inserted groove having a C-shaped groove;

a bottom of said inserted groove having a rectangular groove and an outcurved groove adjacent to said rectangular groove;

a solid shortened copper plate with a tip and an upper round protrusion inserted in said inserted hole, and an upper portion of said shortened copper plate bent flatly;

a rigid, hollow-round, elongated copper plate inserted in said inserted groove;

said elongated copper plate having an elastic plate at an outer periphery of said elongated copper plate, two laternal protrusions at a lower portion of said elongated copper plate, and a sharp end; and a socket cap inserted beneath a bottom of said socket shell.

* * * * *